US010133220B2

(12) United States Patent
Nakamoto et al.

(10) Patent No.: US 10,133,220 B2
(45) Date of Patent: Nov. 20, 2018

(54) FIXING APPARATUS AND IMAGE FORMING APPARATUS HAVING THE SAME

(71) Applicant: CANON KABUSHIKI KAISHA, Tokyo (JP)

(72) Inventors: Atsushi Nakamoto, Tokyo (JP); Satoshi Nishida, Numazu (JP); Isamu Takeda, Machida (JP); Hideo Nanataki, Yokohama (JP); Akimichi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/648,358

(22) Filed: Jul. 12, 2017

(65) Prior Publication Data

US 2018/0024482 A1 Jan. 25, 2018

(30) Foreign Application Priority Data

Jul. 21, 2016 (JP) ..... 2016-143007

(51) Int. Cl.
*G03G 15/20* (2006.01)

(52) U.S. Cl.
CPC ..... *G03G 15/2085* (2013.01)

(58) Field of Classification Search
CPC ..... G03G 15/2039; G03G 15/2053; G03G 15/205; G03G 2215/2035; G03G 15/55
USPC ..... 399/33
See application file for complete search history.

(56) References Cited

U.S. PATENT DOCUMENTS

2008/0261768 A1* 10/2008 Miyawaki ..... G03G 15/757 475/284
2013/0202334 A1* 8/2013 Takahashi ..... G03G 15/206 399/329

FOREIGN PATENT DOCUMENTS

| | | |
|---|---|---|
| JP | 2005173058 A | 6/2005 |
| JP | 2013003502 A | 1/2013 |
| JP | 2015007697 A | 1/2015 |

OTHER PUBLICATIONS

Translation of Hiroshi (JP 2015-007697 A) listed in the IDS, publication date: Jan. 15, 2015.*
Translation of Kohei (JP 2013-003502 A) listed in the IDS, publication date: Jan. 7, 2013.*

* cited by examiner

*Primary Examiner* — Walter L Lindsay, Jr.
*Assistant Examiner* — Frederick Wenderoth
(74) *Attorney, Agent, or Firm* — Canon U.S.A., Inc. IP Division

(57) ABSTRACT

A fixing apparatus for fixing an image onto recording material, includes a heating rotary member, film of a cylindrical shape, and pressure member configured to press the film from inside the film toward the heating rotary member to form a nip portion as an area where the heating rotary member and film contact. The pressure member includes a metallic member extending from an upstream side of a center in a recording material conveyance direction of the nip portion to a downstream side, wherein the recording material on which the image is formed is conveyed while being heated at the nip portion to fix the image onto the recording material. A center of gravity of the metallic member is on the upstream side of the center in the recording material conveyance direction of the nip portion in a cross-section perpendicular to a rotation axis direction of the heating rotary member.

8 Claims, 13 Drawing Sheets

FIXING APPARATUS AND IMAGE FORMING APPARATUS HAVING THE SAME

BACKGROUND OF THE INVENTION

Field of the Invention

The disclosure relates to a fixing apparatus mounted on an image forming apparatus such as an electrophotographic copying machine and an electrophotographic printer, and an image forming apparatus having the fixing apparatus.

Description of the Related Art

An externally heating apparatus is known as a fixing apparatus mounted on an electrophotographic copying machine or printer. Such type of fixing apparatus includes a fixing roller, a heater that forms a heating nip portion by pressurizing a cylindrical film against the fixing roller, and a pressure member that forms a fixing nip portion by pressurizing a cylindrical film against the fixing roller. The fixing roller is heated by the heater via a film at the heating nip portion. A recording material that bears an unfixed toner image is heated at the fixing nip portion while being conveyed, and the toner image is thereby fixed onto the recording material.

Incidentally, it is known that if a small-size recording material is continuously printed by a printer on which the above fixing apparatus is mounted at the same intervals as those of a large-size recording material, the temperature of an area through which a recording material of the fixing roller does not pass (non-passed area) rises excessively.

Japanese Patent Application Laid-Open No. 2013-3502 discusses a configuration to obtain a soaking effect in a longitudinal direction of the fixing roller by using a soaking member (metallic member) made of a thermally conductive metallic material to restrain the temperature rise of a non-passed area of the fixing roller.

According to Japanese Patent Application Laid-Open No. 2013-3502, a soaking member is arranged in an area from an upstream end to a downstream end of the fixing nip portion in a conveyance direction of a recording material and thus, a toner image on the recording material and the fixing roller separate at high temperature at the downstream end of the fixing nip portion. As a result, a temperature margin for a defective image, such as an offset of toner of a toner image to the fixing roller and a lower gloss of a toner image, is likely to decrease.

SUMMARY OF THE INVENTION

According to an aspect of the disclosure, a fixing apparatus is provided for fixing an image onto a recording material, including a heating rotary member, a film having a cylindrical shape, and a pressure member that presses the film from inside the film toward the heating rotary member to form a nip portion which is an area where the heating rotary member and the film contact. The pressure member includes a metallic member extending from an upstream side of a center of the nip portion to a downstream side of the center of the nip portion in a recording material conveyance direction, wherein the recording material on which the image is formed is conveyed while being heated at the nip portion to fix the image onto the recording material. In a cross section perpendicular to a rotation axis direction of the heating rotary member, a center of gravity of the metallic member is on the upstream side of the center of the nip portion in the recording material conveyance direction.

Further features and aspects of the disclosure will become apparent from the following description of numerous example embodiments with reference to the attached drawings.

DESCRIPTION OF THE EMBODIMENTS

Example embodiments of the disclosure will be described in detail based on the drawings. The various embodiments of the disclosure are examples of the embodiments of the disclosure, but the disclosure is not limited to the following example embodiments and various configurations can be replaced with other known configurations without departing from the spirit of the disclosure.

(1) Image Forming Apparatus 100

Figure 1:
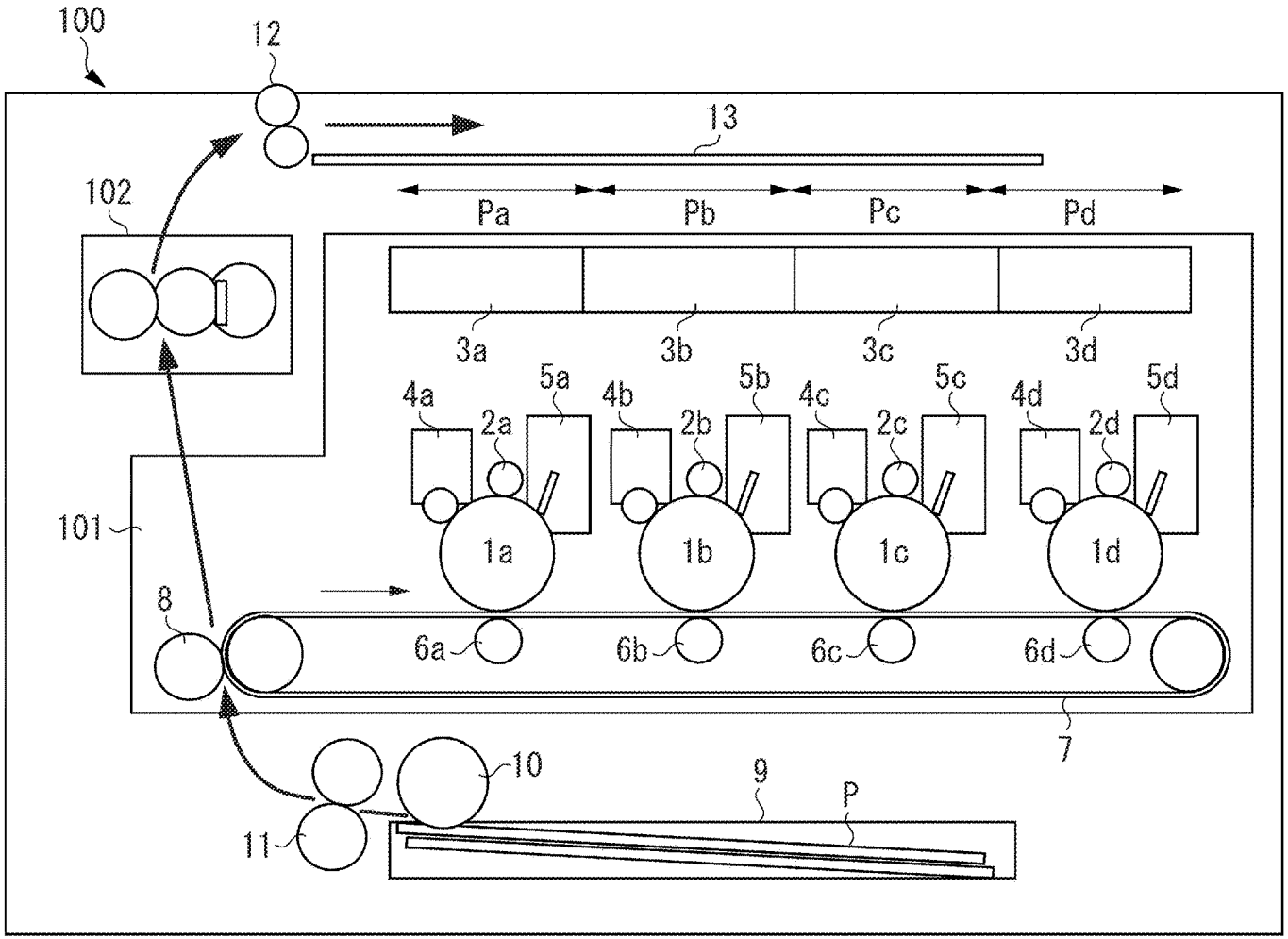
FIG. 1 is a sectional view schematically illustrating a configuration of an example image forming apparatus.

FIG. 1 is a sectional view schematically illustrating a configuration of an image forming apparatus (full-color printer) 100 on which a fixing apparatus (fixing unit) 102 according to a first example embodiment of the disclosure is mounted.

In the image forming apparatus 100, an image forming unit 101 that forms a toner image on a recording material P has four image forming stations Pa, Pb, Pc, and Pd respectively for yellow, magenta, cyan, and black respectively. The image forming stations have photosensitive members 1*a*, 1*b*, 1*c*, and 1*d* in a cylindrical shape as an image bearing member, charging members 2*a*, 2*b*, 2*c*, and 2*d*, laser scanners 3*a*, 3*b*, 3*c*, and 3*d*, and developing units 4*a*, 4*b*, 4*c*, and 4*d*. Further, the image forming stations have cleaners 5*a*, 5*b*, 5*c*, and 5*d* that clean the photosensitive members, and transfer members 6*a*, 6*b*, 6*c*, and 6*d*.

Further, each image forming station has a belt 7 that bears and conveys a toner image transferred from the photosensitive member using transfer member and a secondary transfer member 8 that transfers a toner image from the belt to the recording material P. The operation of the image forming unit 101 described above is known and a detailed description thereof is omitted.

The recording material P stored in a cassette 9 is fed by a roller 10 one by one. The recording material P is conveyed by a roller 11 to a secondary transfer nip portion formed by the belt 7 and the secondary transfer member 8. The recording material P to which a toner image has been transferred at the secondary transfer nip portion is sent to the fixing apparatus 102 and the toner image is heat-fixed to the recording material P by the fixing apparatus. The recording material P conveyed through the fixing apparatus 102 is discharged to a discharging portion 13 by a roller 12.

(2) Fixing Apparatus 102

Figure 2:
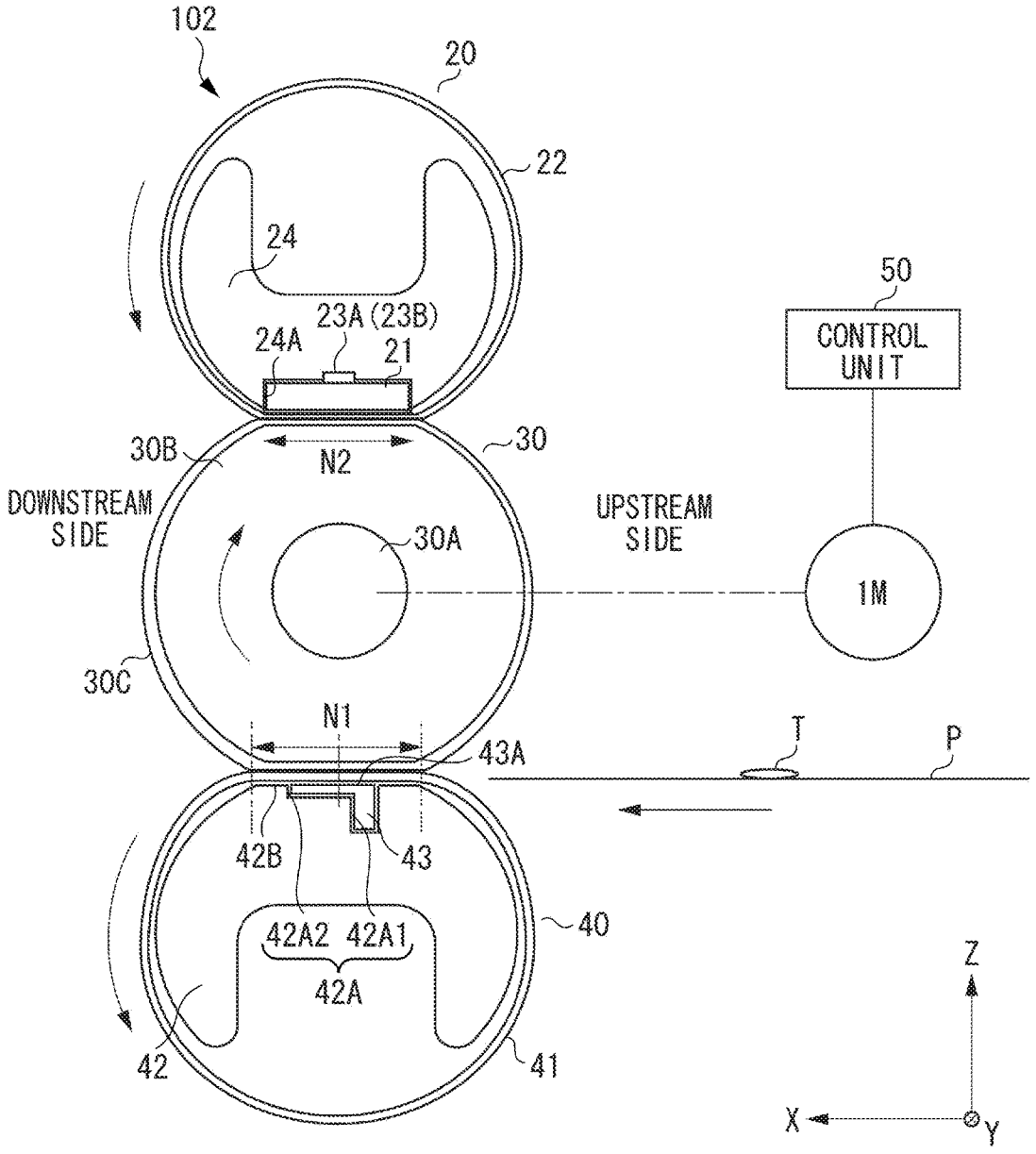
FIG. 2 is a sectional view schematically illustrating a configuration of a fixing apparatus according to a first example embodiment.
Figure 3:
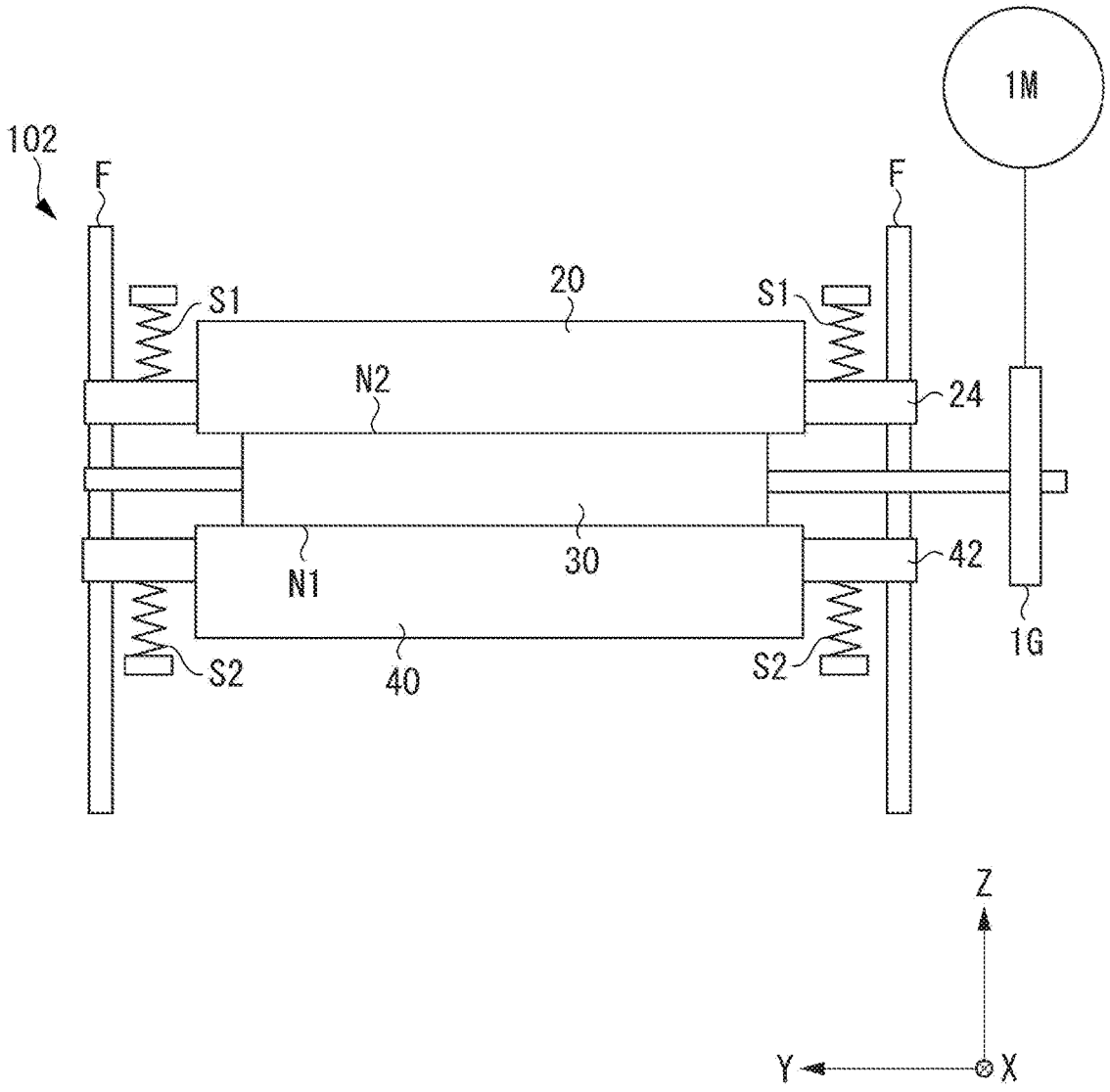
FIG. 3 is a front view when the fixing apparatus is viewed from the upstream side in a conveyance direction of a recording material.
Figure 4A:
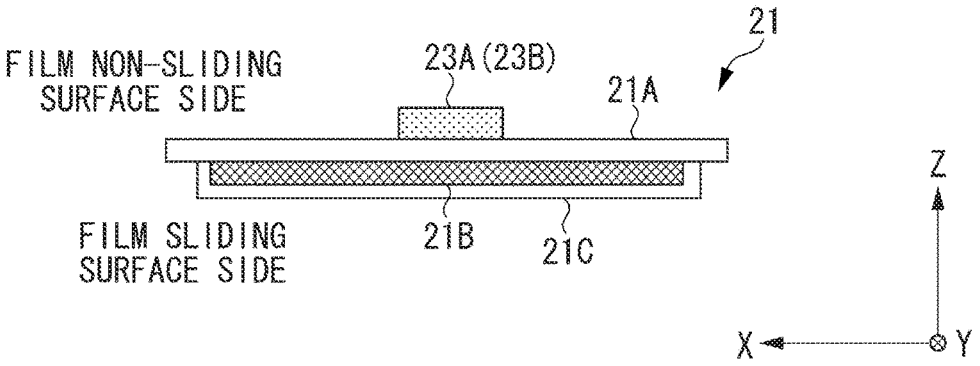
FIGS. 4A, 4B, and 4C are diagrams illustrating the configuration of a heater.
Figure 4B:
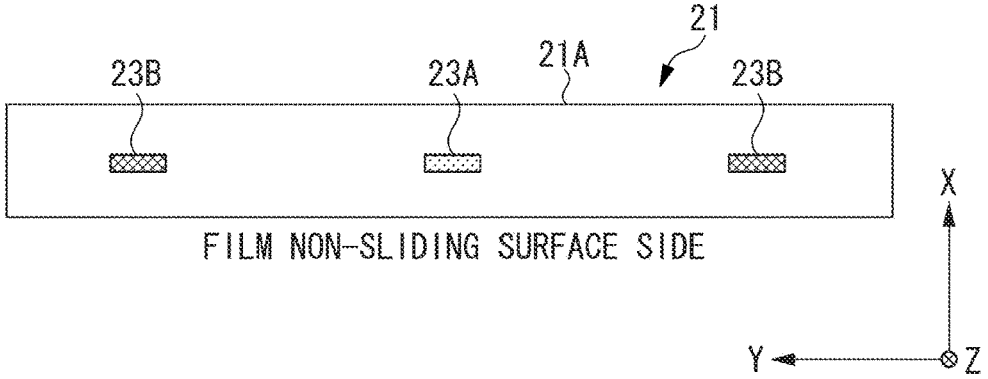
Figure 4C:
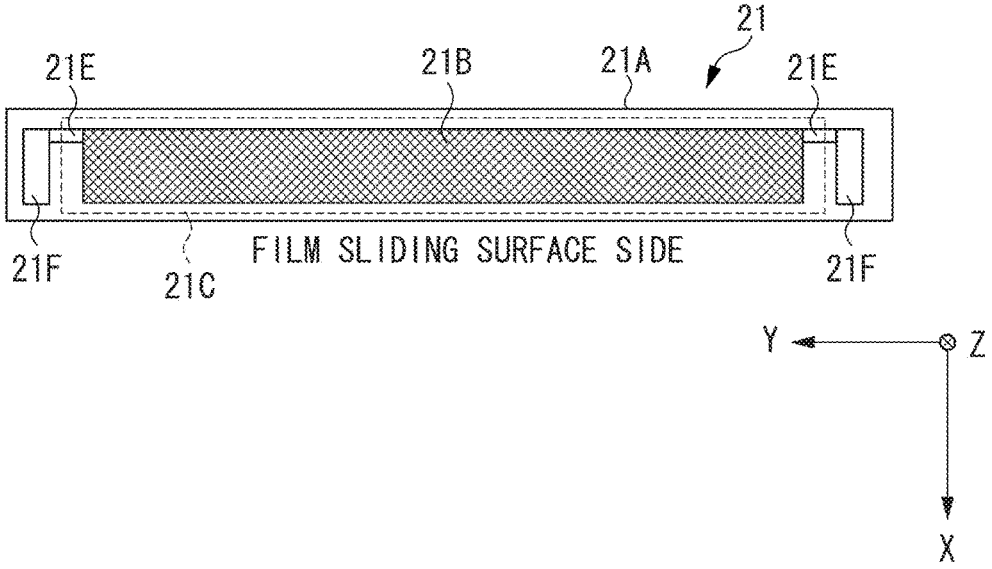
Figure 5:
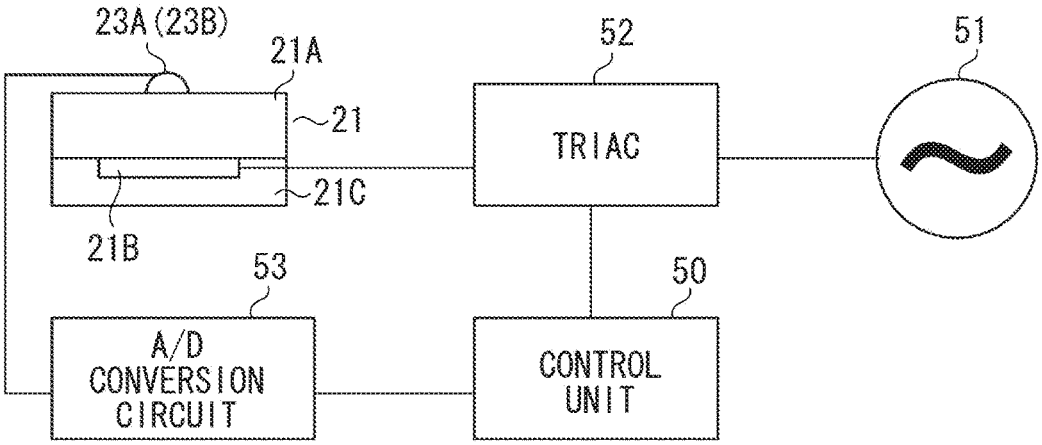
FIG. 5 is a block diagram illustrating an energization control system of the heater.

FIG. 2 is a sectional view schematically illustrating a configuration of the fixing apparatus 102. FIG. 3 is a front view when the fixing apparatus 102 is viewed from the upstream side in a conveyance direction of the recording material P. FIG. 4A is a sectional view schematically illustrating a configuration of a heater, FIG. 4B is a plan view when a heater 21 is viewed from a film non-sliding surface side, and FIG. 4C is a plan view when the heater 21 is viewed from a film sliding surface side. FIG. 5 is a block diagram illustrating an energization control system of the heater 21.

The fixing apparatus 102 includes a pressure unit 40, a fixing roller 30 (heating rotary member), and a heating unit 20.

(2-1) Fixing Roller 30

The fixing roller 30 includes a cored bar 30A made of a metallic material such as iron, stainless steel (SUS), or aluminum. An elastic layer 30B having silicone rubber as the main component is provided on an outer circumferential surface between shaft portions provided on both ends of the cored bar 30A in a longitudinal direction Y orthogonal to a conveyance direction X of the recording material P. Then, a release layer 30C having PTFE, PFA, or FEP as the main component is provided on the outer circumferential surface of the elastic layer 30B. The shaft portions provided on both ends of the cored bar 30A is rotatably supported by a frame F (see FIG. 3) of the fixing apparatus 102. A gear 1G (see FIG. 3) rotated by a motor 1M is mounted on an end of the cored bar 30A.

(2-2) Heating Unit 20

The heating unit 20 includes a ceramic heater (hereinafter, denoted as a heater) 21, a film 22 of a cylindrical shape, and a film guide 24.

The film guide (resin member) 24 provided on an inner circumferential surface (inner surface) side of the film 22 is formed in a substantially concave shape of a cross section using a liquid crystal polymer as a heat-resistant resin material. In the conveyance direction X of the recording material P, the film guide 24 has a groove 24A in a flat surface on the side of the fixing roller 30. The groove 24A is provided along the longitudinal direction Y orthogonal to the conveyance direction X of the recording material P to support the heater 21.

As illustrated in FIGS. 4A, 4B, and 4C, the heater 21 has an elongated substrate 21A in a thin plate shape having ceramic such as alumina or aluminum nitride as the main component. On the substrate surface on the film sliding surface side of a substrate 21A, an energization heating element 21B having silver or palladium as the main component, electrically conductive portions 21E electrically connected to the energization heating element, and electrodes 21F for energization to the electrically conductive portions are printed as patterns along the longitudinal direction of the substrate. Also on the substrate surface, a protective layer 21C having glass or heat-resistant resin such as fluororesin or polyimide as the main component is provided so as to cover the energization heating element 21B.

On the other hand, on the substrate surface, which is the film non-sliding surface side of the substrate 21A, a main thermistor 23A is made to be in contact with the center in the longitudinal direction of the substrate, at which these recording materials always pass when a large-size recording material or a small-size recording material of a narrow width is printed or a neighboring area thereof. The temperature of the recording material passing area of the heater 21 is detected by the main thermistor 23A.

Also, sub-thermistors 23B are made to be in contact with a non-passing area located on end sides in the longitudinal direction of the substrate where recording materials do not pass when a small-size recording material is printed or a large-size recording material is printed by shifting toward an end side in the longitudinal direction of the substrate. The temperature of the recording material non-passing area of the heater 21 is detected by these sub-thermistors 23B.

The film 22 is formed in a cylindrical shape so that an inner circumferential length of the film is longer than an outer circumferential length of the film guide 24 by a predetermined length, and is externally fitted into the film guide loosely without tension. As the layer configuration of the film 22, a two-layer structure, in which the outer circumferential surface of a film base layer in a cylindrical shape having polyimide as the main component is coated with a surface layer in a cylindrical shape having PFA as the main component, is employed.

In the heating unit 20 arranged above the fixing roller 30 in parallel therewith, both ends of the film guide 24 are supported by the frame F of the fixing apparatus 102 in the longitudinal direction Y orthogonal to the conveyance direction X of the recording material P. Further, both ends of the film guide 24 of the heating unit 20 are urged by a pressure spring S1 in a vertical direction orthogonal to a generatrix direction of the fixing roller 30 to press the heater 21 against the outer circumferential surface (surface) of the fixing roller 30 via the film 22.

With this configuration, the elastic layer 30B of the fixing roller 30 is crushed to cause elastic deformation at a position corresponding to the heater 21 to form a heating nip portion N2 of a predetermined width by the surface of the fixing roller and the outer circumferential surface (surface) of the film 22.

(2-3) Pressure Unit 40

The pressure unit 40 includes a film 41 of a cylindrical shape, a film guide (pressure member) 42, and a soaking member 43. The film 41 is formed in a cylindrical shape so that the inner circumferential length of the film is longer than the outer circumferential length of the film guide 42 by a predetermined length, and is externally fitted into the film guide loosely without tension. As the layer configuration of the film 41, a two-layer structure, in which the outer circumferential surface of the film base layer in a cylindrical shape having polyether ether ketone (PEEK) as the main component, is coated with the surface layer in a cylindrical shape having PFA as the main component is adopted.

The film guide 42 provided on the inner circumferential surface side of the film 41 is formed in a substantially concave shape of the cross section using a liquid crystal polymer as a heat-resistant resin material. In the conveyance direction X of the recording material P, the film guide 42 has a nip forming portion 42B in a flat shape on the side of the fixing roller 30. The nip forming portion 42B is provided with a groove 42A (see FIG. 2) along the longitudinal direction Y orthogonal to the conveyance direction X of the recording material P.

The groove 42A has two grooves 42A1 and 42A2 of different depths from the nip forming portion 42B in the conveyance direction X of the recording material P and in a thickness direction Z of the recording material orthogonal to the longitudinal direction Y orthogonal to the conveyance direction of the recording material respectively. The depth of a first groove 42A1 provided on the upstream side of a fixing nip portion N1 in the conveyance direction X of the recording material P is deeper than that of a second groove 42A2 provided on the downstream side of the fixing nip portion. In other words, the groove 42A has an L shape in the conveyance direction X of the recording material P. The soaking member 43 to form the fixing nip portion N1 is supported by the groove 42A together with the nip forming portion 42B.

The soaking member 43 is formed in a shape that fits into the groove 42A. A flat nip forming portion 43A provided on the inner surface side of the film 41 of the soaking member 43 fitted into the groove 42A is flush with the nip forming portion 42B of the film guide 42.

To equalize the temperature of the fixing nip portion N1 via the film 41 in the longitudinal direction Y orthogonal to the conveyance direction X of the recording material P, a material superior in thermal conductivity is desirable as the material of the soaking member 43. Also, the material needs to have appropriate heat capacity so as not to absorb more heat than necessary, and further needs mechanical strength to keep the fixing nip portion N1 in a uniform nip shape. Thus, in the present example embodiment, aluminum is used as the material of the soaking member 43.

In the pressure unit 40 arranged in parallel with the fixing roller 30, both ends of the film guide 42 are supported by the frame F in the longitudinal direction Y orthogonal to the conveyance direction X of the recording material P. Further, both ends of the film guide 42 of the pressure unit 40 are urged by a pressure spring S2 in the vertical direction orthogonal to the generatrix direction of the fixing roller 30 to press the nip forming portions 43A and 42B of the soaking member 43, and the film guide 42 against the surface of the fixing roller via the film 41.

With this configuration, the elastic layer 30B of the fixing roller 30 is crushed to cause elastic deformation at positions corresponding to the nip forming portion 43A of the soaking member 43 and the nip forming portion 42B of the film guide 42 to form the fixing nip portion N1 of a predetermined width from the surface of the fixing roller 30 and the surface of the film 41.

(2-4) Heating and Fixing Process Operation by Fixing Apparatus 102

The heating and fixing process operation by the fixing apparatus 102 will be described with reference to FIG. 2.

A control unit 50 including a CPU and memories such as a ROM and a RAM drives the motor 1M to rotate according to a print signal to rotate the fixing roller 30 in an arrow direction. Following the rotation of the fixing roller 30, the film 41 of the pressure unit 40 rotates in an arrow direction while the inner surface of the film slides on the nip forming portion 43A of the soaking member 43 and the nip forming portion 42B of the film guide 42. Also, following the rotation of the fixing roller 30, the film 22 of the heating unit 20 rotates in an arrow direction while the inner surface of the film slides on the protective layer 21C of the heater 21.

Power is supplied to the electrodes 21F of the heater 21 from a commercial power supply 51 (see FIG. 5) via a triac 52. The energization heating element 21B is heated by being energized from the electrodes 21F via the electrically conductive portions 21E, and the temperature of the heater 21 rises rapidly to heat the surface of the fixing roller 30 at the heating nip portion N2 via the film 22.

The control unit 50 takes in a detection temperature by the main thermistor 23A for monitoring the temperature of the heater 21 via an analog-to-digital (A/D) conversion circuit 53. Then, the control unit 50 controls the amount of energization supplied to the heater 21 by controlling ON/OFF of the triac 52 so that the heater 21 maintains a predetermined fixing temperature (target temperature).

The recording material P bearing an unfixed toner image T is heated while being conveyed between the surface of the fixing roller 30 and the surface of the pressure film 41 at the fixing nip portion N1, and the toner image is thereby fixed onto the recording material.

(3) Measures Against Excessive Temperature Rise of Non-Passing Portion of Fixing Apparatus 102

(3-1) Excessive Temperature Rise of Non-Passing Portion and Measures Thereof

When heat of the fixing roller 30 is conducted to the soaking member 43 via the film 41 of the pressure unit 40 in the fixing apparatus 102, the soaking member attempts to equalize internal heat to maintain a thermal equilibrium state. The speed of this phenomenon depends on thermal conductivity of the soaking member 43 and equalization of heat is achieved more quickly with increasing thermal conductivity. In addition, if thermal conductivity of the soaking member 43 is large, the soaking member actively exchanges heat with the fixing roller 30 at the fixing nip portion N1 via the film 41.

Thus, even if a temperature difference arises in the fixing roller 30 in the longitudinal direction Y orthogonal to the conveyance direction X of the recording material P, the temperature difference can be made smaller by the soaking member 43. Therefore, even if a non-passing portion temperature rise arises in an area (non-passing portion) where the recording material of the fixing roller 30 does not pass in the longitudinal direction Y orthogonal to the conveyance direction X of the recording material P, the soaking member 43 makes the temperature difference between an area (passing portion) where the recording material of the fixing roller passes and a non-passing portion smaller. Accordingly, the temperature of a non-passing portion of the fixing roller can be prevented from rising markedly.

For this reason, a metallic material of high thermal conductivity such as SUS, aluminum, aluminum alloys, copper, silver, gold, iron, carbon steel, and graphite alloys can be used as the material of the soaking member 43. Alternatively, a material of high thermal conductivity such as a ceramic material, for example, aluminum nitride, silicon carbide, alumina, silicon nitride, and boron nitride or a carbon material, for example, a graphite sheet can be used.

(3-2) Thermal Conductivity Measurement

The transient hot wire method was used to measure thermal conductivity of the soaking member 43 and the film guide 42 of the pressure unit 40. More specifically, measurements were made by the transient hot wire method (probe method) using a measuring apparatus QTM-500 (manufactured by Kyoto Electronics Manufacturing Co., Ltd.).

In addition, PD-13 was used as the probe. Thermal conductivity λ is given by the following formula (1):

$$\lambda = \frac{Q}{4\pi} \cdot \frac{\ln\left(\frac{t_2}{t_1}\right)}{T_2 - T_1} \quad \text{Formula (1)}$$

where Q is the amount of heat released per unit length of the hot wire/unit time, T1 is the temperature of the hot wire at time t1, and T2 is the temperature of the hot wire at time t2. Based on these definitions, a straight line is obtained by plotting the logarithm of time ts on the horizontal axis and a temperature rise ΔTs on the vertical axis, and thermal conductivity is determined from the gradient of the straight line. Thermal conductivities of the soaking member 43 and the film guide 42 are illustrated in Table 1.

TABLE 1

| | Material | Thermal Conductivity |
|---|---|---|
| Soaking Member | Aluminum | 238 |
| Film Guide | Liquid Crystal Polymer | 0.52 |

(4) Offset of Toner to Film 22 of Heating Unit 20 and Measure Against Lower Gloss of Toner Image T Using the soaking member 43 for the pressure unit is effective as a measure against the excessive temperature rise of a non-passing portion of the fixing roller 30.

However, a configuration in which a material of large specific heat such as a metallic material is arranged up to the vicinity of the downstream end of the fixing nip portion N1 in the conveyance direction X of the recording material P decreases a temperature margin for a defective image such as an offset of toner to the film 22 and a lower gloss of the toner image T. This is because heat is also provided to the recording material P from the soaking member 43 that is sufficiently heated in a state in which sufficient heat is stored like when continuous printing has been done.

To avoid such a state, a configuration in which a material of large specific heat is not arranged near the downstream end of the fixing nip portion N1 in the conveyance direction X of the recording material P is effective. This configuration can lower the temperature of the recording material P near the downstream end of the fixing nip portion N1.

Figure 6B:
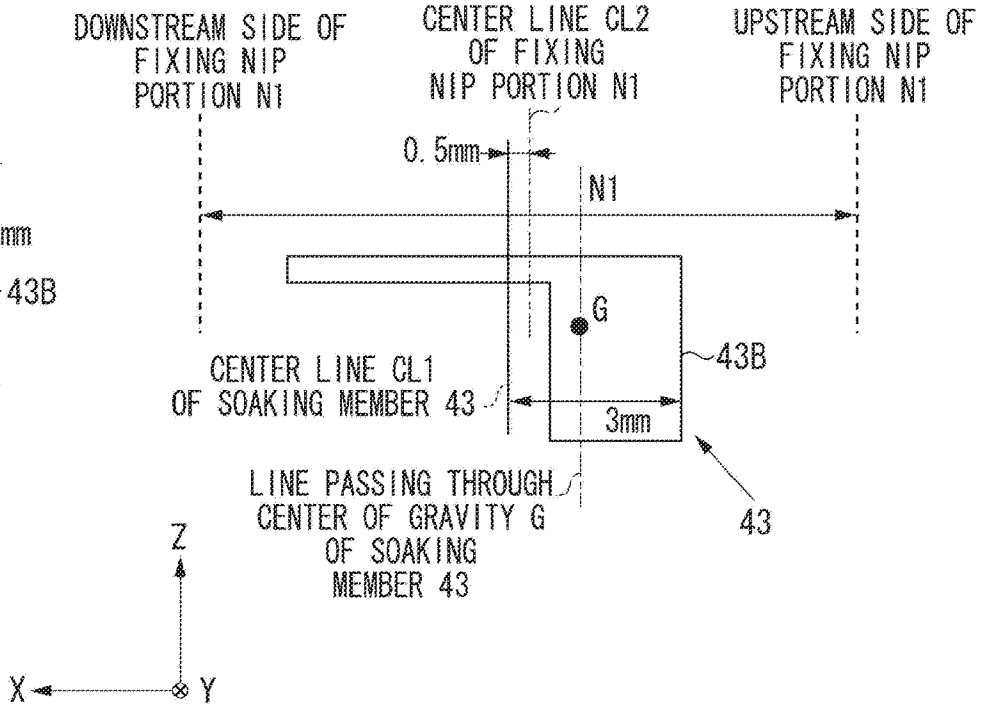
FIGS. 6A and 6B are diagrams illustrating a soaking member according to the first example embodiment.
Figure 6A:
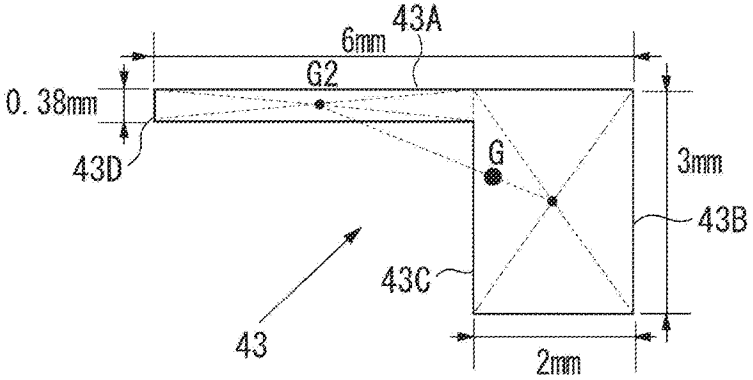

FIG. 6A is a sectional view illustrating a shape of a soaking member, and FIG. 6B is a sectional view illustrating a position of the soaking member relative to the fixing nip portion N1.

The fixing apparatus 102 according to the present example embodiment is characterized in that the soaking member 43 is arranged in the nip forming portion 42B of the film guide 42 in the conveyance direction X of the recording material P as described below.

As illustrated in FIG. 6A, the soaking member 43 has an L sectional shape in the conveyance direction X of the recording material P. The length of the nip forming portion 43A of the soaking member 43 along the conveyance direction X of the recording material P is 6.0 mm. The length up to an inner surface 43C between an outer surface 43B on the upstream side and an outer surface 43D on the downstream side of the fixing nip portion N1 of the soaking member 43 in the conveyance direction X of the recording material P is 2 mm. The length in the thickness direction Z of the recording material P in a region from the outer surface 43B to the inner surface 43C is 3 mm. The length in the thickness direction Z of the recording material P in a region from the inner surface 43C to the outer surface 43D is 0.38 mm.

As illustrated in FIG. 6B, a center line (center) CL1 of the soaking member 43 passes through the point of 3.0 mm from the outer surface 43B of the soaking member in the conveyance direction X of the recording material P. The center line CL1 of the soaking member 43 is shifted to the downstream side from a center line (center) CL2 of the fixing nip portion N1 by 0.5 mm in the conveyance direction X of the recording material P.

As illustrated in FIG. 6A, a center of gravity G of the soaking member 43 is on a line segment G1G2 connecting a center of gravity G1 of a rectangle (2×3 mm) of the cross section of the soaking member 43 on the upstream side in the conveyance direction X of the recording material and a center of gravity G2 of a rectangle (4×0.38 mm) on the downstream side. An internally dividing point obtained by internally dividing the line segment G1G2 in the ratio of the area of the rectangle on the downstream side and the area of the rectangle on the upstream side is the center of gravity G.

The center of gravity G of the soaking member 43 is positioned on the upstream side of the center line CL2 of the fixing nip portion N1 in the conveyance direction X of the recording material P.

Here, as illustrated in FIG. 6B, the center of gravity G of the soaking member 43 represents the position of the center of gravity in a cross section of the soaking member 43 orthogonal to the soaking member 43 (cross section in the longitudinal direction Y orthogonal to the conveyance direction of the recording material) in the conveyance direction X of the recording material P.

The material of the film guide 42 including the nip forming portion 42B is a liquid crystal polymer, which is advantageous for cooling-separation of toner and the fixing roller 30. This results from the fact that the specific heat of the nip forming portion 42B of the film guide 42 made of the liquid crystal polymer is smaller than that of the soaking member 43 made of aluminum.

To achieve both of the soaking effect to restrain the excessive temperature rise of the non-passing portion and the cooling-separation effect to restrain the offset of toner, it is necessary to arrange the soaking member 43 having thermal conductivity higher than that of the film guide 42 as described below. More specifically, it is necessary to arrange the soaking member 43 so that the center of gravity G of the soaking member 43 is positioned on the upstream side of the center line CL2 of the fixing nip portion N1 in the conveyance direction X of the recording material P. Further, the material used for the soaking member 43 desirably has thermal conductivity higher than that of the material of the film guide 42.

As a result of intense study, the present inventors found that it is effective for restraining the toner offset to arrange the soaking member 43 for restraining the excessive temperature rise of a non-passing portion of the fixing roller 30 as described above. Based on the study result, the inventors performed verification by arranging the center of gravity G of the soaking member 43 on the upstream side and the downstream side of the fixing nip portion with respect to the center line CL of the fixing nip portion N1. The verification result is illustrated in FIG. 7.

Figure 7:
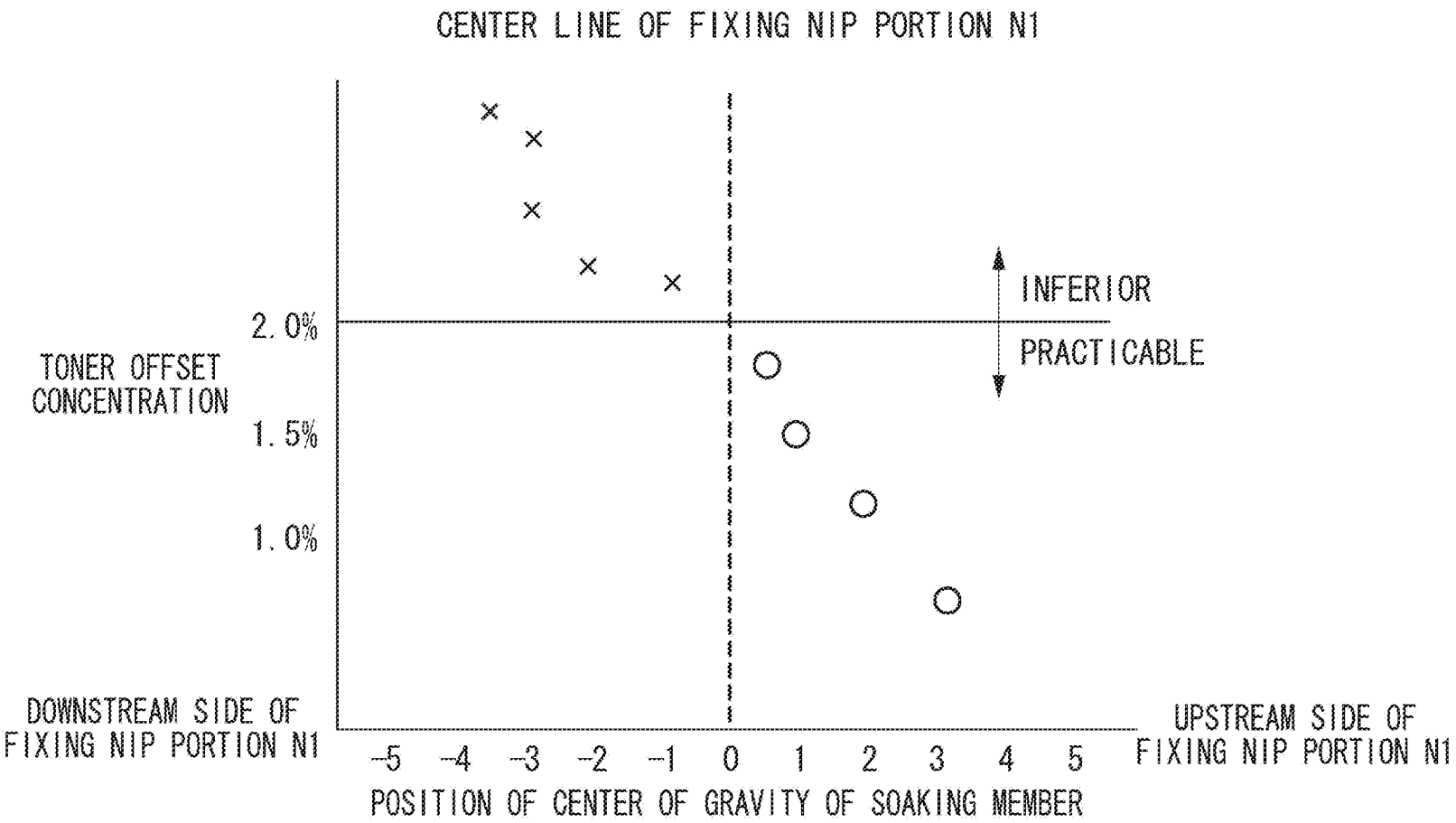
FIG. 7 is a diagram illustrating a correlation between the position of the center of gravity of the soaking member and a toner offset concentration.

FIG. 7 is a diagram illustrating a correlation between the position of the center of gravity of the soaking member 43 and a toner offset concentration.

As is evident from FIG. 7, the toner offset concentration can be maintained at a practical level only when the soaking member 43 is arranged to position the center of gravity of the soaking member 43 on the upstream side of the center line CL of the fixing nip portion N1.

In the fixing apparatus 102 according to the present example embodiment, when the soaking member 43 is divided into the upstream side and the downstream side of the fixing nip portion N1 in the conveyance direction X of the recording material P, the volume of the soaking member on the downstream side of the fixing nip portion is always smaller than that on the upstream side. Therefore, the toner and the fixing roller 30 can advantageously be cooled and separated.

A method for advantageously cooling and separating the toner and the fixing roller 30 on the downstream side of the fixing nip portion N1 of the soaking member 43 by making the volume itself of the soaking member 43 smaller can be considered, but in such a case, the soaking effect of the soaking member 43 decreases and a non-passing temperature rise of the fixing roller cannot be restrained. This is because of dependency on the volume of soaking member 43 used according to the degree of the soaking effect and when comparisons are made with the same soaking effect (i.e., in the same volume), it is advantageous to achieve both of the soaking effect and cooling/separation for a configuration in which the center of gravity of the soaking member 43 is positioned on the upstream side of the center line CL of the fixing nip portion N1.

(5) Image Evaluation

A defective image due to the excessive temperature rise of the non-passing portion of the fixing roller 30 and the offset of toner to the fixing roller 30 were verified using the image forming apparatus 100 including the fixing apparatus 102 according to the present example embodiment. The process speed of the image forming apparatus 100 is 150 mm/s and the fixing temperature is set to 180° C. for the temperature of the heater 21. The pressure applied to the heating unit 20 and that applied to the fixing roller 30 of the pressure unit 40 are each 98 N (10 kgf) and the width of the heating nip portion N2 formed by the fixing roller 30 with both units and that of the fixing nip portion N1 are each set to 10 mm.

The verification of a defective image due to the excessive temperature rise of the non-passing portion of the fixing roller 30 was performed by the following procedure. In an environment of the temperature 15° C. and the humidity 15%, a character image of the printing ratio 5% was printed on 100 sheets using A5 (width: 148 mm, length: 210 mm) size paper of common LBP printing paper whose grammage is 80 g/m$^2$. Immediately thereafter, whether a defective image is caused due to the non-passing portion temperature rise was checked by conveying LETTER (width: 215.9 mm, length: 279.4 mm) size paper wider than the A5 size paper and for which an area of the fixing roller 30 that is a non-passing portion when A5 size paper is conveyed becomes a passing portion.

More specifically, an image that produces solid black from the paper tip up to 100 mm and solid white after 100 mm was output to LETTER size paper. Then, a reflectance D1 (%) of a solid white portion that becomes a non-passing portion when A5 size paper is conveyed and a passing portion when LETTER size paper is conveyed and a reflectance D2 (%) of an unused portion of the same size paper were measured at five points using a white photometer to calculate an average value thereof. Here, TC-6DS/A (manufactured by Tokyo Denshoku Co., Ltd.) was used as the white photometer.

Then, the value of "D1 average value−D2 average value" was considered as non-passing portion temperature rise soiling and a determination was made based on the following criteria:

A: Very good (non-passing portion temperature rise soiling is less than 1.0%)

B: Good (non-passing portion temperature rise soiling is 1.0% or more and less than 1.5%)

C: Practicable (non-passing portion temperature rise soiling is 1.5% or more and less than 2.0%)

D: Inferior (non-passing portion temperature rise soiling is 2.0% or more)

If the non-passing portion temperature rise soiling is less than 1.5%, the excessive temperature rise of the non-passing portion was determined to be good.

The verification of a defective image due to an offset of toner to the film 22 of the heating unit 20 was also performed by basically following the same procedure as that used for verification of a defective image due to the excessive temperature rise of the non-passing portion. In an environment of the temperature 15° C. and the humidity 15%, an image that produces solid black from the paper tip up to 100 mm and solid while after 100 mm was output to LETTER size paper whose grammage is 150 g/m$^2$. Then, the reflectance D1 (%) of a solid white portion and the reflectance D2 (%) of an unused portion of the same size paper were measured at five points using the white photometer TC-6DS/A to calculate an average value thereof.

Then, the value of "D1 average value−D2 average value" was considered as a toner offset concentration and a determination was made based on the following criteria:

A: Very good (toner offset concentration is less than 1.0%)

B: Good (toner offset concentration is 1.0% or more and less than 1.5%)

C: Practicable (toner offset concentration is 1.5% or more and less than 2.0%)

D: Inferior (toner offset concentration is 2.0% or more)

If the toner offset concentration is less than 1.5%, the toner offset was determined to be good.

In the image forming apparatus 100 including the fixing apparatus 102 according to the present example embodiment, the evaluation of non-passing portion temperature rise and the evaluation of toner offset indicated good results for both (see Table 1).

The fixing apparatus 102 according to a second example embodiment is configured in the same manner as the fixing apparatus 102 according to the first example embodiment except that the shape of the groove 42A of the film guide 42 of the pressure unit 40 and the shape and arrangement of the soaking member 43 are different.

Figure 8B:
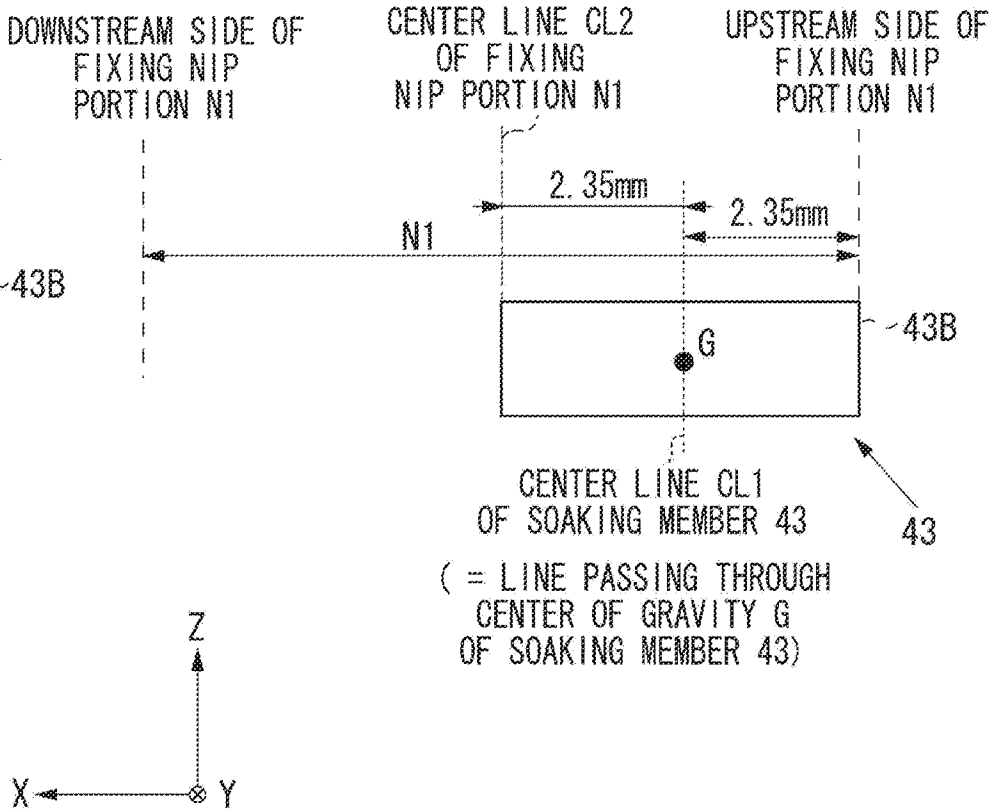
FIGS. 8A and 8B are diagrams illustrating a soaking member according to a second example embodiment.
Figure 8A:
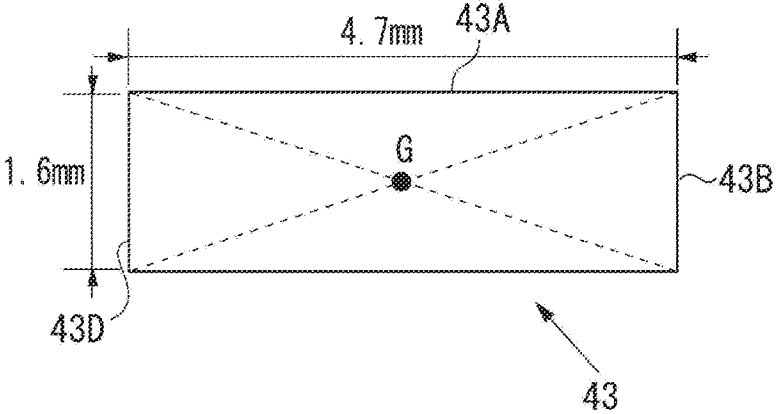

FIG. 8A is a sectional view illustrating the shape of the soaking member 43, and FIG. 8B is a sectional view illustrating the position of the soaking member 43 relative to the fixing nip portion N1.

As illustrated in FIG. 8A, the soaking member 43 has a rectangular sectional shape in the conveyance direction X of the recording material P. The intersection of diagonal lines of the rectangle is the center of gravity G. The length of the nip forming portion 43A of the soaking member 43 along the conveyance direction X of the recording material P is 4.7 mm. In the conveyance direction X of the sheet P, the length in the thickness direction Z of the recording material P in a region from the outer surface 43B on the upstream side to the outer surface 43D on the downstream side of the fixing nip portion N1 of the soaking member 43 is 1.6 mm.

As illustrated in FIG. 8B, the center line CL1 of the soaking member 43 (=the line passing through the center of gravity G of the soaking member) passes through points of 2.35 mm from the outer surface 43B of the soaking member 43 in the conveyance direction X of the recording material P. The center line CL1 of the soaking member 43 is shifted to the upstream side from the center line CL2 of the fixing nip portion N1 by 2.35 mm in the conveyance direction X of the recording material P. Thus, the soaking member 43 is arranged in the groove 42A of the film guide 42 so that the center of gravity G of the soaking member 43 is positioned on the upstream side of the center line CL2 of the fixing nip portion N1 in the conveyance direction X of the recording material P. The groove 42A is formed in a shape into which the soaking member 43 fits.

The fixing apparatus 102 according to the present example embodiment is configured so that the soaking member 43 is present only on the upstream side of the center line CL2 of the fixing nip portion N1 in the conveyance direction X of the recording material P and the temperature of the recording material P can be decreased at a region near the downstream end of the fixing nip portion N1.

The fixing apparatus 102 according to a third example embodiment is configured in the same manner as the fixing apparatus 102 according to the second example embodiment except that the shape of the nip forming portion 42B of the film guide 42 of the pressure unit 40 is different.

Figure 9:
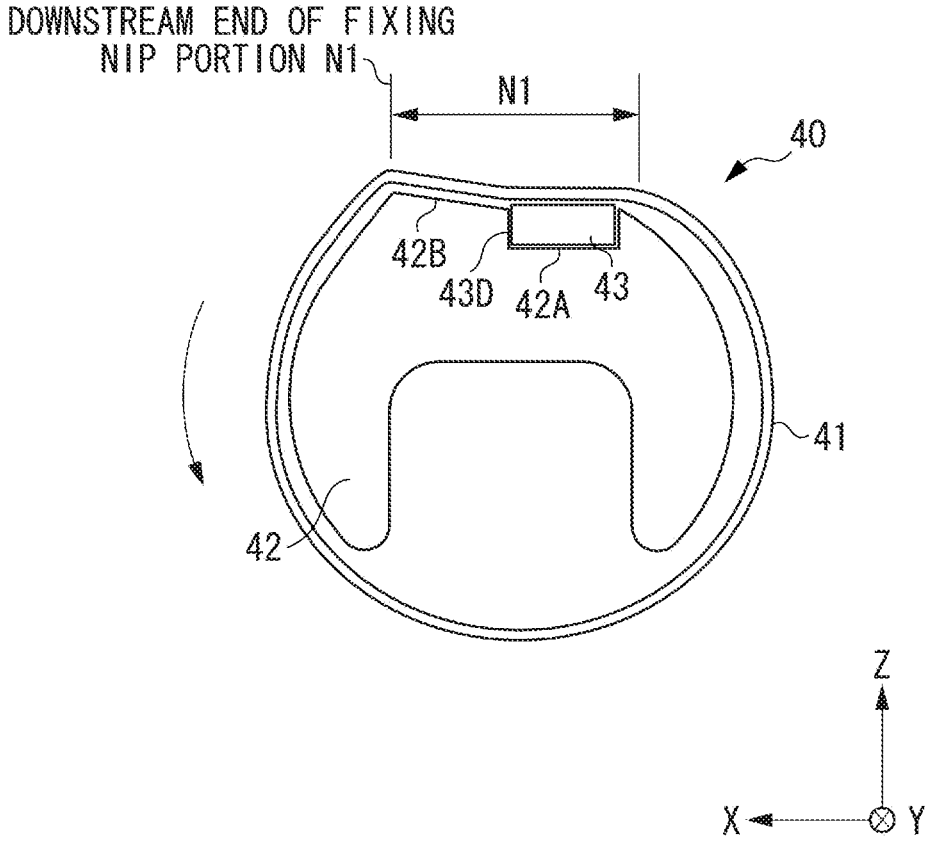
FIG. 9 is a sectional view schematically illustrating a configuration of a pressure unit of a fixing apparatus according to a third example embodiment.
Figure 10:
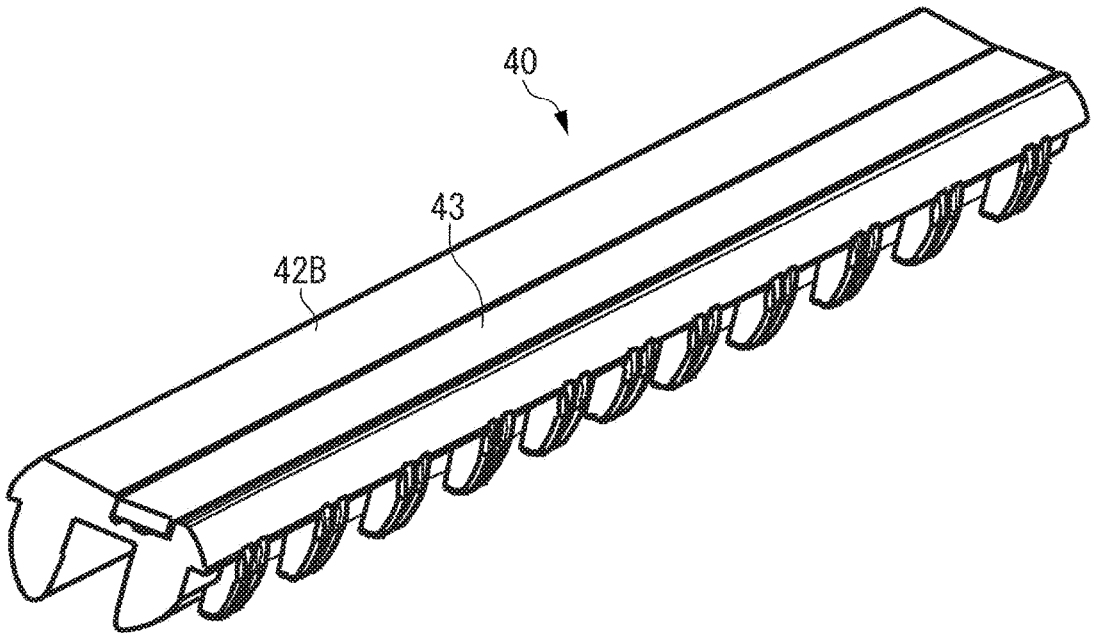
FIG. 10 is a perspective view when a film of the pressure unit illustrated in FIG. 9 is removed.

FIG. 9 is a sectional view schematically illustrating a configuration of the pressure unit 40. FIG. 10 is a perspective view when the pressure unit 40 from which the film 41 has been removed is viewed from the side of the nip forming portion 42B of the film guide 42.

As illustrated in FIG. 9, in the conveyance direction X of the recording material P, the nip forming portion 42B of the film guide 42 has a shape in which the height thereof increases to the side of the fixing roller 30 while proceeding to the downstream side of the fixing nip portion N1.

As a result, the distortion of the fixing roller 30 increases and the fixing nip portion N1 increases in size. In other words, in the conveyance direction X of the recording material P, the distance from the outer surface 43D on the downstream side of the fixing nip portion N1 of the soaking member 43 to the downstream end of the fixing nip portion becomes larger than that in the fixing apparatus 102 according to the second example embodiment, so that the temperature of the recording material P at a portion near the downstream end of the fixing nip portion can be lowered.

The fixing apparatus 102 according to a fourth example embodiment is configured in the same manner as the fixing apparatus 102 according to the first example embodiment except that the heating unit 20 of the fixing apparatus 102 is removed and also a heating roller (heating rotary member) 70 is used instead of the fixing roller 30.

Figure 11:
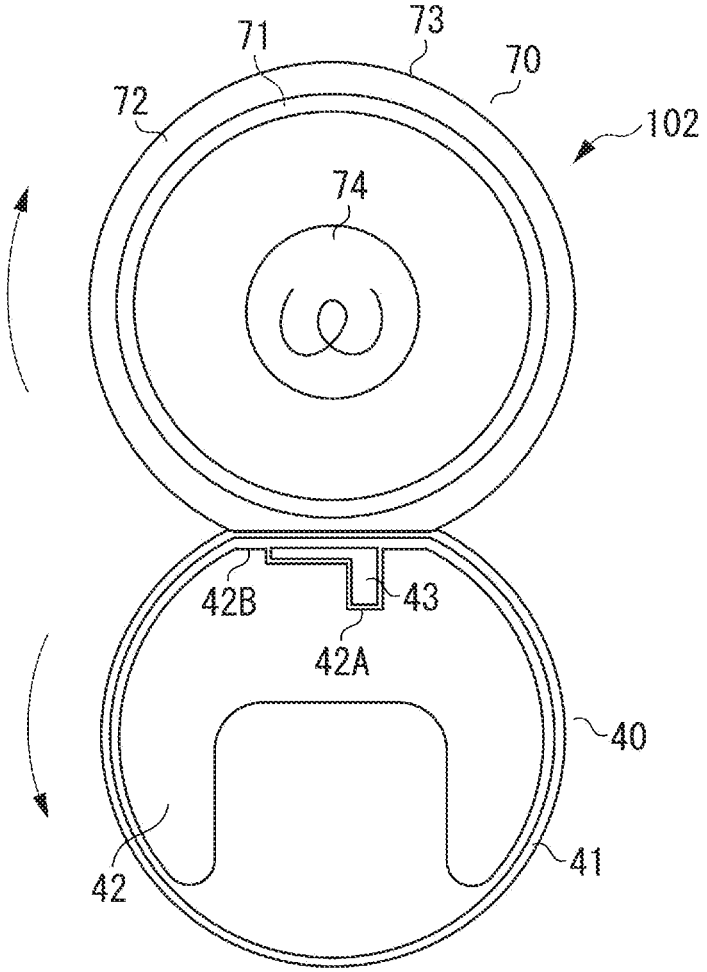
FIG. 11 is a diagram illustrating a soaking member according to a fourth example embodiment.

FIG. 11 is a sectional view schematically illustrating a configuration of the fixing apparatus 102 according to the present example embodiment.

The heating roller 70 includes a halogen heater 74 inside a cored bar 71 of a cylindrical shape, an elastic layer 72 on the outer circumferential surface of the cored bar 71, and a release layer 73 having fluororesin such as PTFE, PFA, and the like as the outermost layer on the outer circumferential surface of the elastic layer 72.

The same operation effect as that of the fixing apparatus 102 according to the first example embodiment can be obtained from the fixing apparatus 102 in the present example embodiment. Also, by using the pressure unit 40 according to the second example embodiment instead of the pressure unit 40 of the fixing apparatus 102 according to the present example embodiment, the same operation effect as that of the second example embodiment can be obtained. Also, by using the pressure unit 40 according to the third example embodiment instead of the pressure unit 40 of the fixing apparatus 102 according to the present example embodiment, the same operation effect as that of the third example embodiment can be obtained.

The fixing apparatus 102 according to a comparative example 1 is configured in the same manner as the fixing apparatus 102 according to the first example embodiment except that the shape of the groove 42A of the film guide 42 of the pressure unit 40 and the shape and arrangement of the soaking member 43 are different.

Figure 12B:
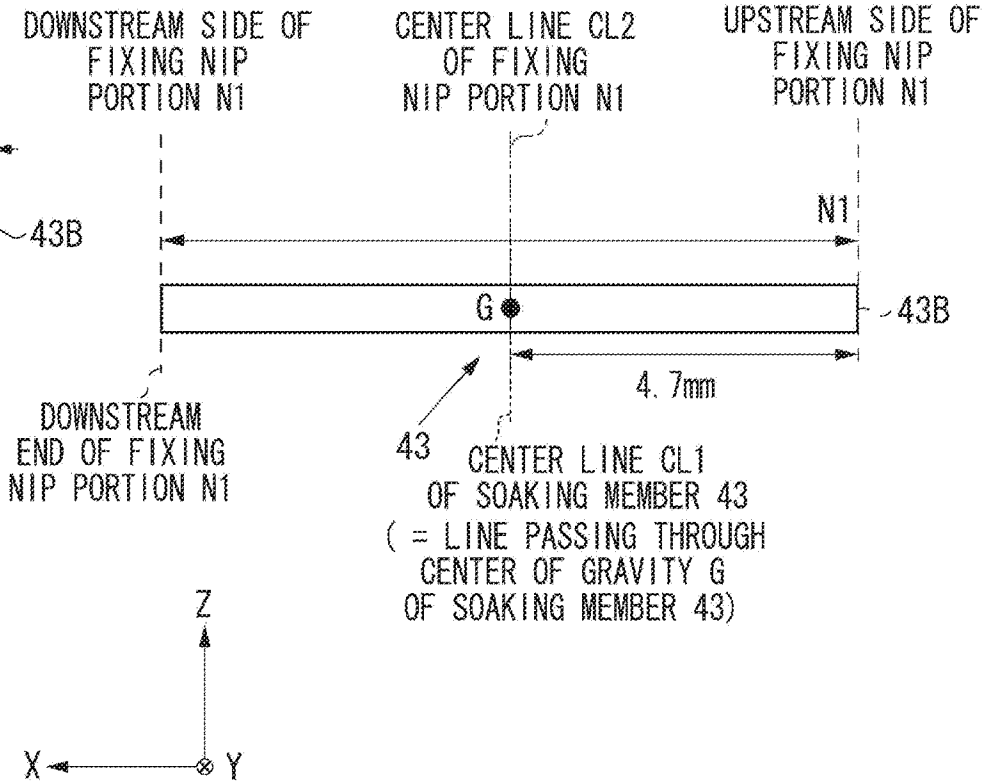
FIGS. 12A and 12B are diagrams illustrating a soaking member according to a comparative example 1.
Figure 12A:
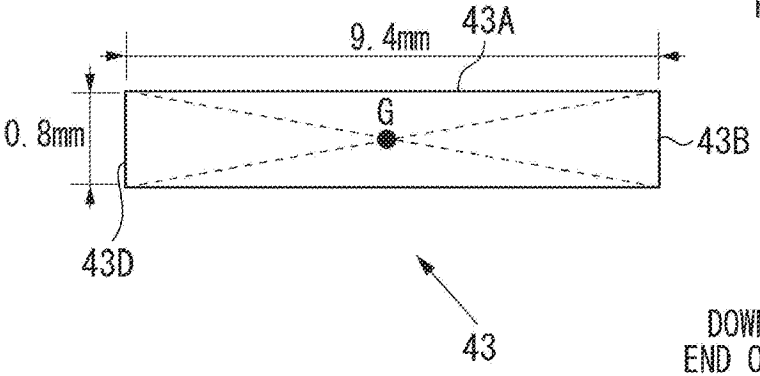

FIG. 12A is a sectional view illustrating the shape of the soaking member 43, and FIG. 12B is a sectional view illustrating the position of the soaking member 43 relative to the fixing nip portion N1.

As illustrated in FIG. 12A, the soaking member 43 has a rectangular sectional shape in the conveyance direction X of the recording material P. The length of the nip forming portion 43A of the soaking member 43 along the conveyance direction X of the recording material P is 9.4 mm. In the conveyance direction X of the recording material P, the length in the thickness direction Z of the recording material P in a region from the outer surface 43B on the upstream side to the outer surface 43D on the downstream side of the fixing nip portion N1 of the soaking member 43 is 0.8 mm.

As illustrated in FIG. 12B, the center line CL1 of the soaking member 43 (=line passing through the center of gravity G of the soaking member 43) passes through the points of 4.7 mm from the outer surface 43B of the soaking member 43 in the conveyance direction X of the recording material P. The center line CL1 of the soaking member 43 matches the position of the center line CL2 of the fixing nip portion N1 in the conveyance direction X of the recording material P. In this way, the soaking member 43 is arranged in the groove 42A of the film guide 42 so that the center of gravity G of the soaking member is positioned on the center line CL2 of the fixing nip portion N1 in the conveyance direction X of the recording material P. The groove 42A is formed in a shape into which the soaking member 43 fits.

The fixing apparatus 102 according to the comparative example 1 has the soaking member 43 extending throughout the fixing nip portion N1 in the conveyance direction X of the recording material P. In other words, the soaking member 43 is present from the center line CL2 of the fixing nip portion N1 to the downstream end in the conveyance direction X of the recording material P. Thus, the cooling-separation effect to restrain the toner offset is not obtained.

The fixing apparatus 102 according to a comparative example 2 is configured in the same manner as the fixing apparatus 102 according to the first example embodiment except that the material of the soaking member 43 is different.

The fixing apparatus 102 according to the comparative example 2 uses a liquid crystal polymer as the material of the soaking member 43. Because the material of the soaking member 43 is replaced by the liquid crystal polymer having a small thermal conductivity, a sufficient soaking effect cannot be obtained and a defective image due to the non-passing portion temperature rise of the fixing roller 30 cannot be restrained.

The fixing apparatus 102 according to the comparative example 3 is configured in the same manner as the fixing apparatus 102 according to the first example embodiment except that the shape of the groove 42A of the film guide 42 of the pressure unit 40 and the shape and arrangement of the soaking member 43 are different.

Figure 13B:
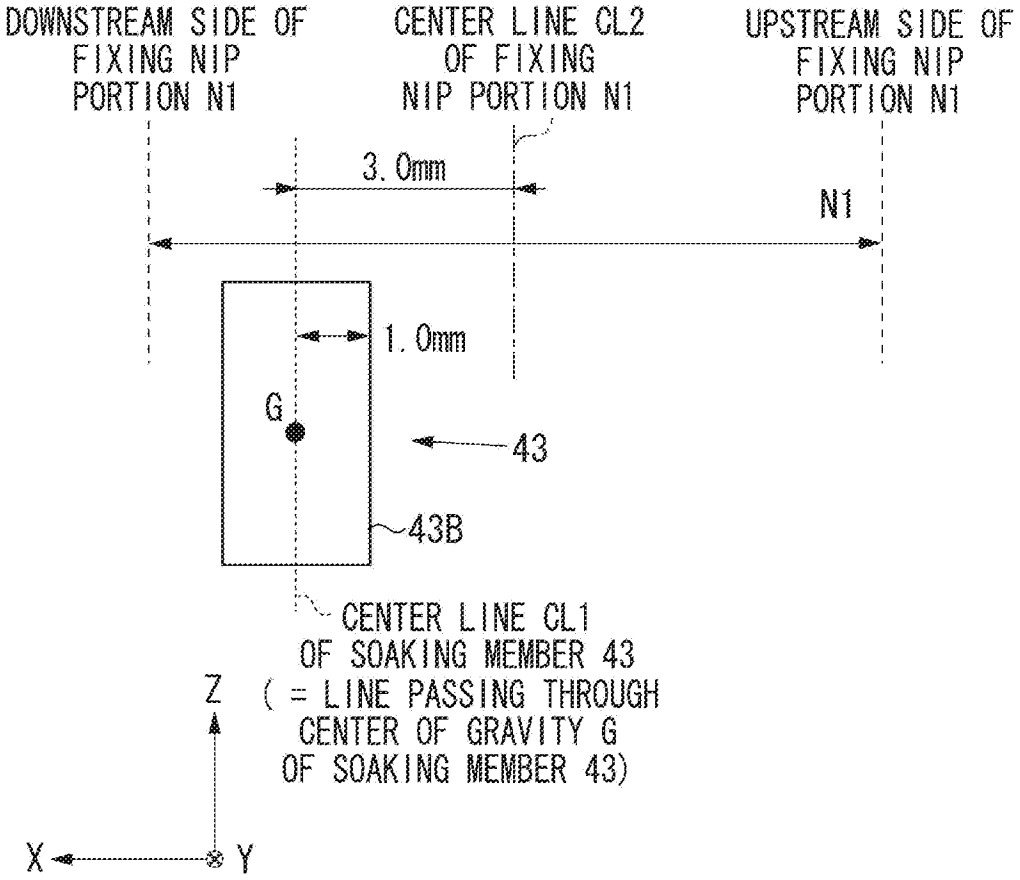
FIGS. 13A and 13B are diagrams illustrating a soaking member according to a comparative example 3.
Figure 13A:
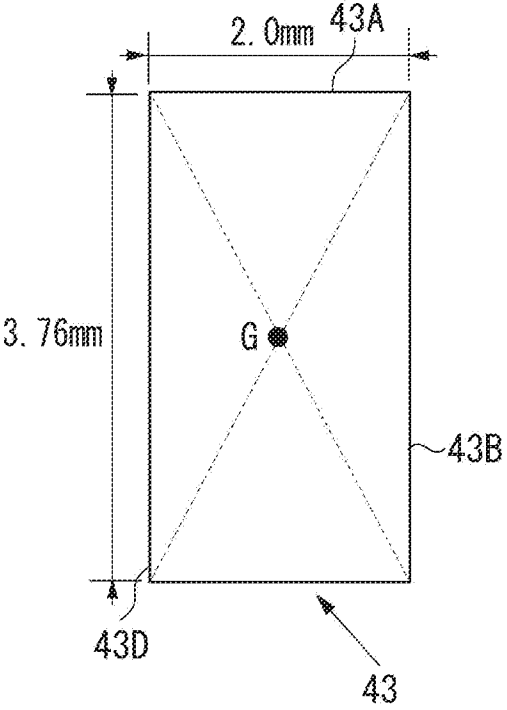

FIG. 13A is a sectional view illustrating the shape of the soaking member 43, and FIG. 13B is a sectional view illustrating the position of the soaking member 43 relative to the fixing nip portion N1.

As illustrated in FIG. 13A, the soaking member 43 has a rectangular sectional shape in the conveyance direction X of the recording material P. The length of the nip forming portion 43A of the soaking member 43 along the conveyance direction X of the recording material P is 2.0 mm. Then, the length in the thickness direction Z of the recording material P in a region from the outer surface 43B on the upstream side to the outer surface 43D on the downstream side of the fixing nip portion N1 of the soaking member 43 is 3.76 mm.

As illustrated in FIG. 13B, the center line CL1 of the soaking member 43 (=line passing through the center of gravity G of the soaking member) passes through points of 1 mm from the outer surface 43B of the soaking member 43 in the conveyance direction X of the recording material P. The center line CL1 of the soaking member 43 is shifted to the downstream side from the center line CL2 of the fixing nip portion N1 by 3.0 mm in the conveyance direction X of the recording material P. Thus, the soaking member 43 is arranged in the groove 42A of the film guide 42 so that the center of gravity G of the soaking member is positioned on the downstream side of the center line CL2 of the fixing nip portion N1 in the conveyance direction X of the recording material P. The groove 42A is formed in a shape into which the soaking member 43 fits.

Because the center of gravity G of the soaking member 43 is not positioned on the upstream side of the center line CL2 of the fixing nip portion N1 in the conveyance direction X of the recording material P, the fixing apparatus 102 according to the comparative example 3 cannot obtain the cooling-separation effect to restrain the toner offset.

Results of evaluating a defective image due to the non-passing portion temperature rise of the fixing roller 30 and an offset of toner to the heating film side using the fixing apparatus 102 of each of the first to third example embodiments and the comparative examples 1 to 3 are shown in Table 2. Also, results of evaluating a defective image due to the non-passing portion temperature rise of the heating roller 70 and an offset of toner to the heating film side using the fixing apparatus 102 of the third example embodiment described above are also shown in Table 2. In these results, each of the soaking members 43 has the same volume.

higher than that of the film guide (pressure film guide) 42 is arranged so that the center of gravity G of the soaking member 43 is positioned on the upstream side of the center line CL of the fixing nip portion N1 in the conveyance direction X of the recording material P. In the first example embodiment, the soaking effect to restrain the non-passing portion temperature rise of the fixing roller 30 and the cooling-separation effect to restrain the offset of toner can both be achieved.

In the second example embodiment, the outer surface 43D of the soaking member 43 on the downstream side in the conveyance direction X of the recording material P matches the center line CL of the fixing nip portion N1. In other words, in the conveyance direction X of the recording material P, the soaking member 43 is present only on the upstream side of the center line CL2 of the fixing nip portion N1. Accordingly, the temperature of the recording material P at a portion near the downstream end of the fixing nip portion N1 in the conveyance direction X of the recording material P can further be lowered. Also in the second example embodiment, the soaking effect to restrain the non-passing portion temperature rise of the fixing roller 30 and the cooling-separation effect to restrain the offset of toner can both be achieved.

In the third example embodiment, in addition to the arrangement of the soaking member 43 according to the second example embodiment, the nip forming portion 42B of the film guide 42 has a smooth curved surface shape of a curvature R20. Accordingly, the distance from the outer surface 43D of the soaking member 43 on the downstream side of the fixing nip portion N1 in the conveyance direction X of the recording material P to the downstream end of the fixing nip portion increases, so that the temperature of the recording material P at a portion near the downstream end of the fixing nip portion can further be lowered. Also in the third example embodiment, the soaking effect to restrain the non-passing portion temperature rise of the fixing roller 30 and the cooling-separation effect to restrain the offset of toner can both be achieved.

TABLE 2

| | Thermal conductivity of film guide (W/(mk)) | Thermal conductivity of soaking member (W/(mk)) | Center of gravity of soaking member is positioned upstream of fixing nip center | Center of soaking member is positioned upstream of fixing nip center | Defective image due to non-passing portion temperature rise | Toner offset |
|---|---|---|---|---|---|---|
| First Example Embodiment | 0.52 | 238 | YES | NO | B | B |
| Second Example Embodiment | 0.52 | 238 | YES | YES | A | A |
| Third Example Embodiment | 0.52 | 238 | YES | YES | A | A |
| Fourth Example Embodiment | 0.52 | 238 | YES | NO | B | B |
| Comparative Example 1 | 0.52 | 238 | NO | NO | A | D |
| Comparative Example 2 | 0.52 | 0.52 | YES | YES | D | A |
| Comparative Example 3 | 0.52 | 238 | NO | NO | C | D |

The first example embodiment has a configuration in which the soaking member 43 having thermal conductivity The fourth example embodiment employs a configuration including the heating roller 70 that includes the halogen heater 74 as the heating unit and employs the pressure unit 40 configured in the same manner as the pressure unit 40 in the first example embodiment. Also in the fourth example embodiment, the soaking effect to restrain the non-passing portion temperature rise of the fixing roller 30 and the cooling-separation effect to restrain the offset of toner can both be achieved.

The comparative example 1 employs a configuration in which the soaking member 43 having large heat capacity is arranged on the downstream side of the fixing nip portion N1 in the conveyance direction X of the recording material P and therefore, the cooling-separation effect to restrain the offset of toner is not obtained.

The comparative example 2 uses a liquid crystal polymer for the soaking member 43 and thus, thermal conductivity of the soaking member is not larger than that of the film guide 42. Therefore, a sufficient soaking effect cannot be obtained and a defective image due to the non-passing portion temperature rise cannot be restrained.

In Comparative Example 3, the center of gravity G of the soaking member 43 is not positioned on the upstream side of the center line CL1 of the fixing nip portion N1 in the conveyance direction X of the recording material P and therefore, the cooling-separation effect to restrain the offset of toner is not obtained.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-143007, filed Jul. 21, 2016, which is hereby incorporated by reference herein in its entirety.

What is claimed is:

1. A fixing apparatus for fixing an image onto a recording material, the fixing apparatus comprising:

a heating rotary member;

a film having a cylindrical shape; and a pressure member that presses the film from inside the film toward the heating rotary member to form a nip portion which is an area where the heating rotary member and the film contact, the pressure member including a metallic member extending from an upstream side of a center of the nip portion to a downstream side of the center of the nip portion in a recording material conveyance direction and a resin member that supports the metallic member and press the film toward the heating rotary member, wherein the recording material on which the image is formed is conveyed while being heated at the nip portion to fix the image onto the recording material, wherein the metallic member and the resin member are in contact with an inner surface of the film, wherein the nip portion is formed between the heating rotary member and an area of the film with which the metallic member and the resin member are in contact in the recording material conveyance direction, wherein in a cross section perpendicular to a rotation axis direction of the heating rotary member, a center of gravity of the metallic member is on the upstream side of the center of the nip portion in the recording material conveyance direction, wherein, of the resin member, a portion that is located downstream of the nip portion in the recording material conveyance direction protrudes toward the heating rotary member beyond the metallic member.

2. The fixing apparatus according to claim 1, wherein, of the resin member, the portion protruding toward the heating rotary member has a shape whose amount of protrusion increases toward the downstream side in the recording material conveyance direction.

3. The fixing apparatus according to claim 1, further comprising a heating unit for heating the heating rotary member, wherein the heating unit contacts with an outer surface of the heating rotary member.

4. The fixing apparatus according to claim 1, further comprising a heater for heating the heating rotary member, wherein the heater is provided in an inside space of the heating rotary member.

5. A fixing apparatus for fixing an image onto a recording material, the fixing apparatus comprising:

a heating rotary member;

a film having a cylindrical shape; and a pressure member that presses the film from inside the film toward the heating rotary member to form a nip portion which is an area where the heating rotary member and the film contact, the pressure member including a metallic member and a resin member that supports the metallic member and press the film toward the heating rotary member, wherein the recording material on which the image is formed is conveyed while being heated at the nip portion to fix the image onto the recording material, wherein the metallic member and the resin member are in contact with an inner surface of the film, wherein the nip portion is formed between the heating rotary member and an area of the film with which the metallic member and the resin member are in contact in the recording material conveyance direction, wherein, of the resin member, a portion that is located downstream of a position of the metallic member in the recording material conveyance direction and forms the nip portion protrudes toward the heating rotary member beyond the metallic member.

6. The fixing apparatus according to claim 5, wherein, of the resin member, the portion protruding toward the heating rotary member has a shape whose amount of protrusion increases toward the downstream side in the recording material conveyance direction.

7. The fixing apparatus according to claim 5, further comprising a heating unit for heating the heating rotary member, wherein the heating unit contacts with an outer surface of the heating rotary member.

8. The fixing apparatus according to claim 5, further comprising a heater for heating the heating rotary member, wherein the heater is provided in an inside space of the heating rotary member.

* * * * *